US010144223B2

(12) United States Patent
Sato et al.

(10) Patent No.: US 10,144,223 B2
(45) **Date of Patent: *Dec. 4, 2018**

(54) LIQUID EJECTING APPARATUS AND PRESSURE-REGULATING DEVICE

(71) Applicant: SEIKO EPSON CORPORATION, Tokyo (JP)

(72) Inventors: Masahiko Sato, Matsumoto (JP); Hitotoshi Kimura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/829,368

(22) Filed: Dec. 1, 2017

(65) Prior Publication Data

US 2018/0099509 A1 Apr. 12, 2018

Related U.S. Application Data

(63) Continuation of application No. 15/268,850, filed on Sep. 19, 2016, now Pat. No. 9,855,760.

(30) Foreign Application Priority Data

Sep. 25, 2015 (JP) ..... 2015-187842

(51) Int. Cl.
*B41J 2/18* (2006.01)
*B41J 2/175* (2006.01)
*B41J 2/165* (2006.01)

(52) U.S. Cl.
CPC ..... *B41J 2/17596* (2013.01); *B41J 2/1652* (2013.01); *B41J 2/16526* (2013.01);
(Continued)

(58) Field of Classification Search
CPC ..... B41J 2/17596; B41J 2/17556; B41J 2/17513; B41J 2/18; B41J 2/175;
(Continued)

(56) References Cited

U.S. PATENT DOCUMENTS

2005/0073559 A1 4/2005 Aruga et al.
2012/0127242 A1 5/2012 Koike et al.
2017/0087867 A1 3/2017 Sato et al.

FOREIGN PATENT DOCUMENTS

JP 2004-142405 5/2004
JP 2009-178889 8/2009
(Continued)

OTHER PUBLICATIONS

Office Action issued in U.S. Appl. No. 15/268,850 dated May 8, 2017.

*Primary Examiner* — Julian D Huffman
(74) *Attorney, Agent, or Firm* — Workman Nydegger

(57) ABSTRACT

A liquid ejecting apparatus includes a liquid inflow unit provided in the liquid supply path which supplies a liquid to a liquid ejecting unit and into which the liquid flows, a liquid accommodation unit having a diaphragm section, a communication path through which the liquid inflow part and the liquid accommodation part communicate, and a pressure-regulating mechanism having an on-off valve which opens and closes the communication path in response to displacement of the diaphragm portion, and a pressing mechanism which puts the on-off valve in an open state regardless of the pressure in the liquid inflow unit by pressing the diaphragm portion.

12 Claims, 8 Drawing Sheets

(52) U.S. Cl.
CPC ..... *B41J 2/175* (2013.01); *B41J 2/17513* (2013.01); *B41J 2/17556* (2013.01); *B41J 2/17563* (2013.01); *B41J 2/18* (2013.01); *B41J 2002/16594* (2013.01); *B41J 2002/16597* (2013.01)

(58) Field of Classification Search
CPC ..... B41J 2/16526; B41J 2/1652; B41J 2002/16597; B41J 2002/16594
See application file for complete search history.

(56) References Cited

FOREIGN PATENT DOCUMENTS

| | | |
|---|---|---|
| JP | 2011-240565 | 12/2011 |
| JP | 2012-111044 | 6/2012 |
| JP | 2013-091281 | 5/2013 |
| JP | 2014-188924 | 10/2014 |
| JP | 2015-075146 | 4/2015 |
| WO | 2015-053108 | 4/2015 |

LIQUID EJECTING APPARATUS AND PRESSURE-REGULATING DEVICE

CROSS REFERENCES TO RELATED APPLICATIONS

This application is a continuation of U.S. application Ser. No. 15/268,850, filed Sep. 19, 2016, which claims priority to Japanese Application No. 2015/187842, filed Sep. 25, 2015, the entireties of which are incorporated

BACKGROUND

1. Technical Field

The present invention relates to a liquid ejecting apparatus such as an ink jet printer and a pressure-regulating device which regulates the pressure of a liquid in the liquid ejecting apparatus.

2. Related Art

In the related art, ink jet printers that perform printing by ejecting an ink (liquid) supplied from an ink tank (liquid supply source) to a medium from an ink jet head (liquid ejecting unit) are known an example of a liquid ejecting apparatus. There are printers provided with a damper (pressure-regulating device) which regulates the pressure of ink supplied to the ink jet head within such printers (JP-A-2009-178889).

The damper is provided with an ink path (communication path) that connects a tank side liquid chamber (liquid inflow unit) and a head side liquid chamber (liquid accommodation unit) and a valve (on-off valve) that opens and closes the ink path. The valve is opened in response to the pressure of a pressure varying chamber (pressure-regulating chamber).

The valve in the ink path is closed when the pressure in the tank side liquid chamber becomes a predetermined value or more higher than the pressure in the pressure varying chamber. Therefore, the valve is closed when the pressure which pressurizes the ink increases, even during printing during which the ink pressurized and supplied from the ink tank is ejected from nozzles and during cleaning during which the pressurized and supplied ink is discharged from the nozzles.

That is, the ink is not supplied to the ink jet head when the valve is closed, and printing and cleaning are not performed. Therefore, it is important to restrict and control the pressure at which the ink is supplied in the printer so that is made lower than the pressure at which the valve is closed.

Such problems are not limited to ink jet-type printers, and are substantially shared in liquid ejecting apparatuses and pressure-regulating devices which regulate the pressure of a liquid in a liquid ejecting apparatus.

SUMMARY

An advantage of some aspects of the invention is to provide a liquid ejecting apparatus and a pressure-regulating device able to stably supply a liquid to a liquid ejecting unit.

Hereinafter, means of the invention and operation effects thereof will be described.

According to an aspect of the invention, there is provided a liquid ejecting apparatus including a liquid supply path which is able to supply a liquid from a liquid supply source to a liquid ejecting unit which ejects the liquid from a nozzle; a pressure-regulating mechanism provided in the liquid supply path, the pressure-regulating mechanism which includes a liquid inflow unit into which the liquid supplied from the liquid supply source flows, a liquid accommodation unit which is able to accommodate the liquid in the interior thereof, and for which the volume of the interior changes by displacing a diaphragm portion, a communication path through which the liquid inflow unit and the liquid accommodation unit communicate, and an on-off valve which enters an open state in which the liquid inflow unit and the liquid accommodation unit communicate from a closed state in which the liquid inflow unit and the liquid accommodation unit in the communication path do not communicate, when a pressure applied to a first surface which is an inner surface of the liquid accommodation unit of the diaphragm section is lower than the pressure applied to a second surface which is an outer surface of the liquid accommodation unit of the diaphragm section, and a difference between the pressure applied to the first surface and the pressure applied to the second surface is a predetermined value or more; and a pressing mechanism which is provided to be able to press the diaphragm section in a direction in which the volume of the liquid accommodation unit is reduced, and which puts the on-off valve in an open state regardless of the pressure in the interior of the liquid inflow unit by pressing the diaphragm section.

According to the configuration, the pressing mechanism can put the on-off valve in an open state regardless of the pressure in the liquid inflow unit even if the pressure in the liquid inflow unit fluctuates or increases. Therefore, the liquid can be stably supplied to the liquid ejecting unit.

In the liquid ejecting apparatus, it is preferable that the pressing mechanism include a pressure regulator which is able to regulate a pressure within a pressure-regulating chamber formed on the second surface side of the diaphragm section, and the pressing mechanism press the diaphragm section by the pressure regulator regulating the pressure within the pressure-regulating chamber to be a higher pressure than atmospheric pressure.

According to the configuration, the pressure regulator presses the diaphragm section in the direction in which the volume of the liquid accommodation unit is reduced by regulating the pressure in the pressure-regulating chamber. Therefore, the pressing mechanism can favorably press the diaphragm section.

In the liquid ejecting apparatus, it is preferable that the pressing mechanism further include an expansion and contraction section which is able to expand and contract and which forms the pressure-regulating chamber, and the pressing mechanism press the diaphragm section by the pressure regulator causing the expansion and contraction section to expand.

According to the configuration, the pressure regulator presses the diaphragm section in the direction in which the volume of the liquid accommodation unit is reduced by causing the expansion and contraction section to expand. Therefore, the pressing mechanism can favorably press the diaphragm section.

In the liquid ejecting apparatus, it is preferable that the pressing mechanism press the diaphragm section so that the pressure in the liquid accommodation unit becomes higher than the pressure at which the meniscus formed at the gas-liquid interface collapses in the nozzle.

The liquid is supplied at a higher pressure than the pressure at which the meniscus collapses during pressure cleaning in which the liquid which is pressurized and supplied from the liquid supply source side is discharged from the nozzles. On this feature, according to the configuration, because the pressure in the liquid accommodation unit at which the diaphragm section is pressed by the pressing mechanism is higher than the pressure at which the meniscus collapses, the on-off valve can be put in the open state even in a case of performing pressure cleaning.

In the liquid ejecting apparatus, it is preferable that the pressure-regulating mechanism further include a moving member which is able to move in a state of contact with the diaphragm section which displaces in a direction in which the volume of the liquid accommodation unit is reduced, and the pressing mechanism press a region in the diaphragm section which comes in contact with the moving member.

According to the configuration, because the pressing mechanism presses the region of the diaphragm section in contact with the moving member, deformation of the diaphragm section can be restricted compared to a case where the pressure-regulating mechanism does not include a moving member. Accordingly, concern of gas or the like being drawn in from the nozzles can be reduced in a case where the pressing mechanism releases the pressing of the diaphragm section, and the diaphragm section deforms in a direction in which the volume of the liquid accommodation unit increases.

It is preferable that liquid ejecting apparatus further include a pressurizing mechanism which is able to pressurize the liquid supplied to the pressure-regulating mechanism, in which the liquid pressurized by the pressurizing mechanism is supplied to the liquid ejecting unit in the open state of the on-off valve due to the pressing mechanism pressing the diaphragm section.

According to the configuration, cleaning of the liquid ejecting unit can be favorably performed by supplying the liquid pressurized by the pressurizing mechanism to the liquid ejecting unit in a state where the on-off valve is opened.

In the liquid ejecting apparatus, it is preferable that the pressurizing force which pressurizes the liquid is changed by the pressurizing mechanism in the open state of the on-off valve.

According to the configuration, because the on-off valve can be put in the open state regardless of the pressure in the liquid inflow unit, the on-off valve maintains the open state even if the pressurizing force which pressurizes the liquid by means of the pressurizing mechanism changes. Accordingly, cleaning can be more favorably performed because the liquid can be supplied at a pressurizing force in response to the state of the liquid ejecting unit.

In the liquid ejecting apparatus, it is preferable that the pressing state of the diaphragm section by the pressing mechanism be released and the on-off valve be put in the closed state in a state in which the liquid is pressurized by the pressurizing mechanism.

Because the diaphragm section pressed by the pressing mechanism puts the on-off valve in the open state by displacing in a direction in which the volume of the liquid accommodation unit is reduced, when the pressing of the pressing mechanism is released, the diaphragm section displaces in a direction in which the volume of the liquid accommodation unit increases. On this feature, according to the configuration, because the liquid pressurized by the pressurizing mechanism is supplied to the pressure-regulating mechanism, the concern of the liquid being drawn in from the liquid ejecting unit side can be reduced. Accordingly, the concern of gas or the like being drawn in from the nozzles can be reduced.

It is preferable that the liquid ejecting apparatus drive the actuator of the liquid ejecting unit in the process where the on-off valve is moved from the open state to the closed state.

According to the configuration, the liquid ejecting unit ejects the liquid supplied from the liquid supply source from the nozzles by driving the actuator. That is, because the liquid can be caused to flow from the liquid supply source side towards the liquid ejecting unit side, it is possible to reduce the concern of gas and the like being drawn in from the nozzles.

According to another aspect of the invention, there is provided a pressure-regulating device including a pressure-regulating mechanism provided in a liquid supply path which is able to supply a liquid from a liquid supply source to a liquid ejecting unit which ejects the liquid from a nozzle, the pressure-regulating mechanism which includes a liquid inflow unit into which the liquid supplied from the liquid supply source flows, a liquid accommodation unit which is able to accommodate the liquid in the interior thereof, and for which the volume of the interior changes by displacing a diaphragm portion, a communication path through which the liquid inflow unit and the liquid accommodation unit communicate, and an on-off valve which enters an open state in which the liquid inflow unit and the liquid accommodation unit communicate from a closed state in which the liquid inflow unit and the liquid accommodation unit in the communication path do not communicate, when a pressure applied to a first surface which is an inner surface of the liquid accommodation unit of the diaphragm section is lower than the pressure applied to a second surface which is an outer surface of the liquid accommodation unit of the diaphragm section, and a difference between the pressure applied to the first surface and the pressure applied to the second surface is a predetermined value or more; and a pressing mechanism which is provided to be able to press the diaphragm section in a direction in which the volume of the liquid accommodation unit is reduced, and which puts the on-off valve in an open state regardless of the pressure in the interior of the liquid inflow unit by pressing the diaphragm section.

According to the configuration, the same effects as the liquid ejecting apparatus can be exhibited.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Below, a first embodiment of the liquid ejecting apparatus and the pressure-regulating device will be described with reference to the drawings.

Figure 1:
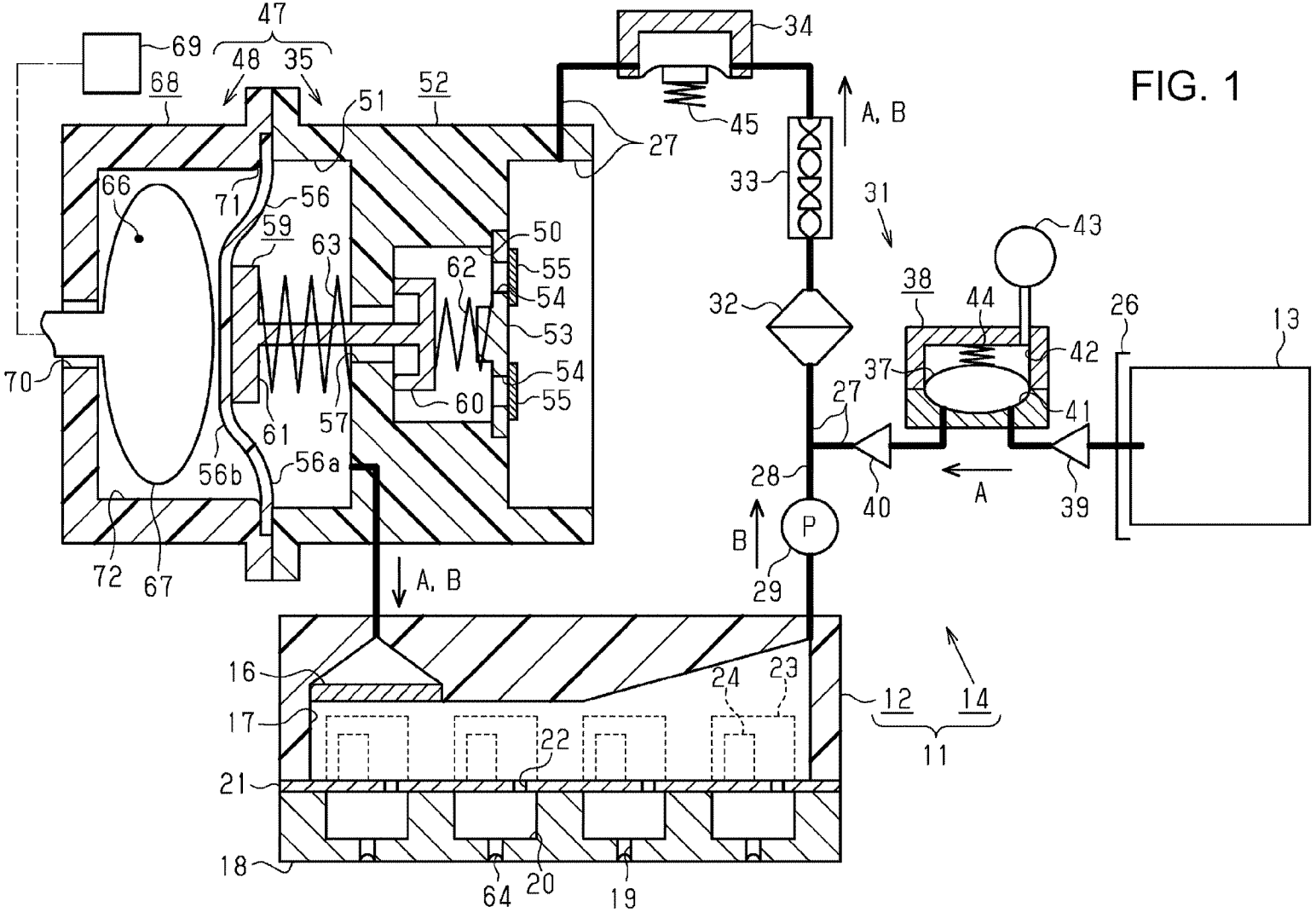
FIG. 1 is a schematic view of a first embodiment of a liquid ejecting apparatus.

As illustrated in FIG. 1, the liquid ejecting apparatus 11 is provided with a liquid ejecting unit 12 which ejects a liquid, and a supply mechanism 14 which supplies the liquid to the liquid ejecting unit 12 from a liquid supply source 13 which is the supply source of the liquid.

The liquid ejecting unit 12 is provided with a liquid ejecting unit filter 16 which captures air bubbles or foreign materials in the liquid and a common liquid chamber 17 which stores the liquid passing through the liquid ejecting unit filter 16. The liquid ejecting unit 12 is further provided with a plurality of pressure chambers 20 by which a plurality of nozzles 19 formed in a nozzle forming surface 18 and the common liquid chamber 17 are communicated. A portion of the wall surface of the pressure chamber 20 is formed by a diaphragm 21, and the common liquid chamber 17 and the pressure chamber 20 communicate through a communication hole 22. An actuator 24 which is accommodated in the accommodation chamber 23 is provided at a different position to the common liquid chamber 17 which is the surface on the opposite side to the portion which faces the pressure chamber 20 in the diaphragm 21.

The actuator 24 is a piezoelectric element which contracts in a case where a driving voltage is applied. After the diaphragm 21 is deformed according to the contraction of the actuator 24, when the application of the driving voltage is released, the liquid in the pressure chamber 20 in which the volume is changed is ejected from the nozzles 19 as liquid droplets. That is, the liquid ejecting unit 12 ejects the liquid from the nozzle 19 when the actuator 24 is driven.

The liquid supply source 13 is an accommodation container able to accommodate the liquid, and may be a cartridge which replenishes the liquid by replacing the accommodation container, or may be an accommodation tank fixed to a mounting section 26. The mounting section 26 holds the liquid supply source 13 to be detachable in a case where the liquid supply source 13 is a cartridge. At least one set of liquid supply source 13 and the supply mechanism (in the embodiment, four sets) is provided per type of liquid ejected from the liquid ejecting unit 12.

The supply mechanism 14 is provided with a liquid supply path 27 which is able to supply the liquid to the liquid ejecting unit 12 which is the upstream side from the liquid supply source 13 which is the upstream side in the supply direction A of the liquid. A portion of the liquid supply path 27 also functions as a circulation path in cooperation with a circulation path forming section 28. That is, the circulation path forming section 28 connects the common liquid chamber 17 and the liquid supply path 27. A circulating pump 29 which causes the liquid in the circulation path to be circulated in the circulation direction B is provided in the circulation path forming section 28.

A pressurizing mechanism 31 which pressurizes and supplies the liquid toward the liquid ejecting unit 12 by causing the liquid to flow from the liquid supply source 13 in the supply direction A is provided in the liquid supply path 27 closer to the liquid supply source 13 side than the position at which the circulation path forming section 28 is connected. A filter unit 32, a static mixer 33, a liquid storage unit 34, and a pressure-regulating mechanism 35 are further provided in the liquid supply path 27, in order from the upstream side, at a portion that also functions as the circulation path further to the downstream side than the position at which the circulation path forming section 28 is connected.

The pressurizing mechanism 31 is provided with a volumetric pump 38 which applies pressure to the liquid while a flexible member 37 having flexibility is reciprocated and one way valves 39 and 40 provided to the upstream and the downstream of the volumetric pump 38, respectively, in the liquid supply path 27.

The volumetric pump 38 includes a pump chamber 41 and a negative pressure chamber 42 divided by the flexible member 37. The volumetric pump 38 is further provided with a pressure reduction unit 43 for reducing the pressure of the negative pressure chamber 42 and a biasing member 44 which biases the flexible member 37 provided in the negative pressure chamber 42 toward the pump chamber 41 side. The one way valves 39 and 40 permits the flow of the liquid from the upstream side to the downstream side in the liquid supply path 27 and regulates the flow of the liquid from the downstream side toward the upstream side. That is, the pressurizing mechanism 31 is able to pressurize the liquid supplied to the pressure-regulating mechanism 35 by the biasing member 44 biasing the liquid in the pump chamber 41 via the flexible member 37. Therefore, the pressurizing force at which the pressurizing mechanism 31 pressurizes the liquid is set by the biasing force of the biasing member 44.

The filter unit 32 traps air bubbles and foreign materials in the liquid, and is provided to be replaceable. The static mixer 33 causes changes such as direction reversal or division in the flow of the liquid and reduces bias of concentration in the liquid. The liquid storage unit 34 stores the liquid in the space with variable volume biases by a spring 45 and alleviates fluctuations in the pressure in the liquid.

Next the pressure-regulating device 47 will be described.

As illustrated in FIG. 1, the pressure-regulating device 47 is provided with a pressure-regulating mechanism 35 which is provided in the liquid supply path 27 and which forms a portion of the liquid supply path 27 and a pressing mechanism 48 which presses the pressure-regulating mechanism 35.

The pressure-regulating mechanism 35 is provided with a main body unit 52 in which the liquid inflow part 50 in which the liquid supplied from the liquid supply source 13 flows via the liquid supply path 27 and the liquid accommodation part 51 which is able to accommodate the liquid in the interior thereof are formed. The liquid supply path 27 and the liquid inflow part 50 are partitioned by a wall section 53 and communicate by means of a through hole 54 formed in the wall section 53. The through hole 54 is blocked by the filter member 55. That is, the liquid in the liquid supply path 27 flows into the liquid inflow part 50 through the filter member 55.

A portion of the wall surface in the liquid accommodation part 51 is formed by the diaphragm portion 56. Whereas the diaphragm portion 56 receives the pressure of the liquid in the liquid accommodation part 51 on the first surface **56*a* which is the inner surface of the liquid accommodation part 51, atmospheric pressure is received on the second surface 56*b* which is the outer surface of the liquid accommodation part 51. Therefore, the diaphragm portion 56 displaces in response to the pressure in the liquid accommodation part 51. The volume of the interior of the liquid accommodation part 51 changes by displacing the diaphragm portion 56. The liquid inflow part 50 and the liquid accommodation part 51 communicate by means of a communication path 57**.

The pressure-regulating mechanism 35 is provided with an on-off valve 59 which is able to switch between a closed state (state illustrated in FIG. 1) in which the liquid inflow part 50 and the liquid accommodation part 51 in the communication path 57 do not communicate, and an open state (state illustrated in FIG. 3) in which the liquid inflow part 50 and the liquid accommodation part 51 are caused to communicate. The on-off valve 59 includes a valve portion 60 which is able to block the communication path 57 and a pressure receiving section 61 which receives pressure from the diaphragm portion 56, and moves by the pressure receiving section 61 is pressed by the diaphragm portion 56. That is, the pressure receiving section 61 also functions as a moving member which is able to move in a state in contact with the diaphragm portion 56 which displaces in the direction in which the volume of the liquid accommodation part 51 is reduced.

An upstream side biasing member 62 is provided in the liquid inflow part 50 and a downstream side biasing member 63 is provided in the liquid accommodation part 51. The upstream side biasing member 62 and the downstream side biasing member 63 bias in the direction in which the on-off valve 59 is opened.

The on-off valve 59 is put in the open state from the closed state when the pressure applied to the first surface 56*a* is lower than the pressure applied to the second surface 56*b* and the difference between the pressure applied to the first surface 56*a* and the pressure applied to the second surface 56*b* is a predetermined value (for example, 1 kPa) or more. The predetermined value is a value determined according to the biasing force of the upstream side biasing member 62, the biasing force of the downstream side biasing member 63, the force necessary for the diaphragm portion 56 to be displaced, the pressing force (sealing load) necessary in order to block the communication path 57 with the valve portion 60, and the pressure in the liquid inflow part 50 which acts on the surface of the valve portion 60 and the pressure in the liquid accommodation part 51. That is, the predetermined value increases as the biasing force of the upstream side biasing member 62 and the downstream side biasing member 63 increases. The biasing force of the upstream side biasing member 62 and the downstream side biasing member 63 are set so that the pressure in the liquid accommodation part 51 is put in a negative pressure state (in a case where the pressure applied to the second surface 56*b* is atmospheric pressure, −1 kPa) in a range able to form meniscus 64 in the gas-liquid interface in the nozzle 19.

It should be noted that the gas-liquid interface is the boundary at which the liquid and the gas come in contact. The meniscus 64 a curved liquid surface at which the liquid is able to contact the nozzle 19, and it is preferable that a concave meniscus 64 suitable to ejection of the liquid be formed in the nozzle 19.

The pressing mechanism 48 is provided with an expansion and contraction section 67 which forms the pressure-regulating chamber 66 on the second surface 56*b* side of the diaphragm section 56, a pressing member 68 which presses the expansion and contraction section 67, and a pressure regulator 69 which is able to regulate the pressure in the pressure-regulating chamber 66.

The expansion and contraction section 67 is formed in a balloon shape by a rubber or a resin, and is able to expand and contract in response to the pressure regulator 69 adjusting the pressure of the pressure-regulating chamber 66, The pressing member 68 is formed in a bottomed cylinder shape, and the expansion and contraction section 67 is inserted in the insertion hole 70 formed in the bottom portion.

The end on the opening 71 side of the inner side surface in the pressing member 68 is given roundness by chamfering. The pressing member 68 forms an air chamber 72 which covers the second surface 56*b* of the diaphragm section 56 by the opening being attached to the pressure-regulating mechanism 35 so that the opening 71 is covered by the pressure-regulating mechanism 35. The pressure in the air chamber 72 is given atmospheric pressure, and the atmospheric pressure acts on the second surface 56*b* of the diaphragm section 56.

That is, the pressure regulator 69 causes the expansion and contraction section 67 to expand and contract by regulating the pressure in the pressure-regulating chamber 66 to be a higher pressure than the atmospheric pressure which is the pressure in the air chamber 72. The pressing mechanism 48 presses the diaphragm section 56 in the direction in which the volume of the liquid accommodation part 51 is reduced by the pressure regulator 69 causing the expansion and contraction section 67 to expand. At this time, the pressing mechanism 48 presses the region in the diaphragm portion 56 which contacts the pressure receiving section 61. The area of the region in the diaphragm portion 56 which contacts the pressure receiving section 61 is greater than the cross-sectional area of the communication path 57.

Figure 2:
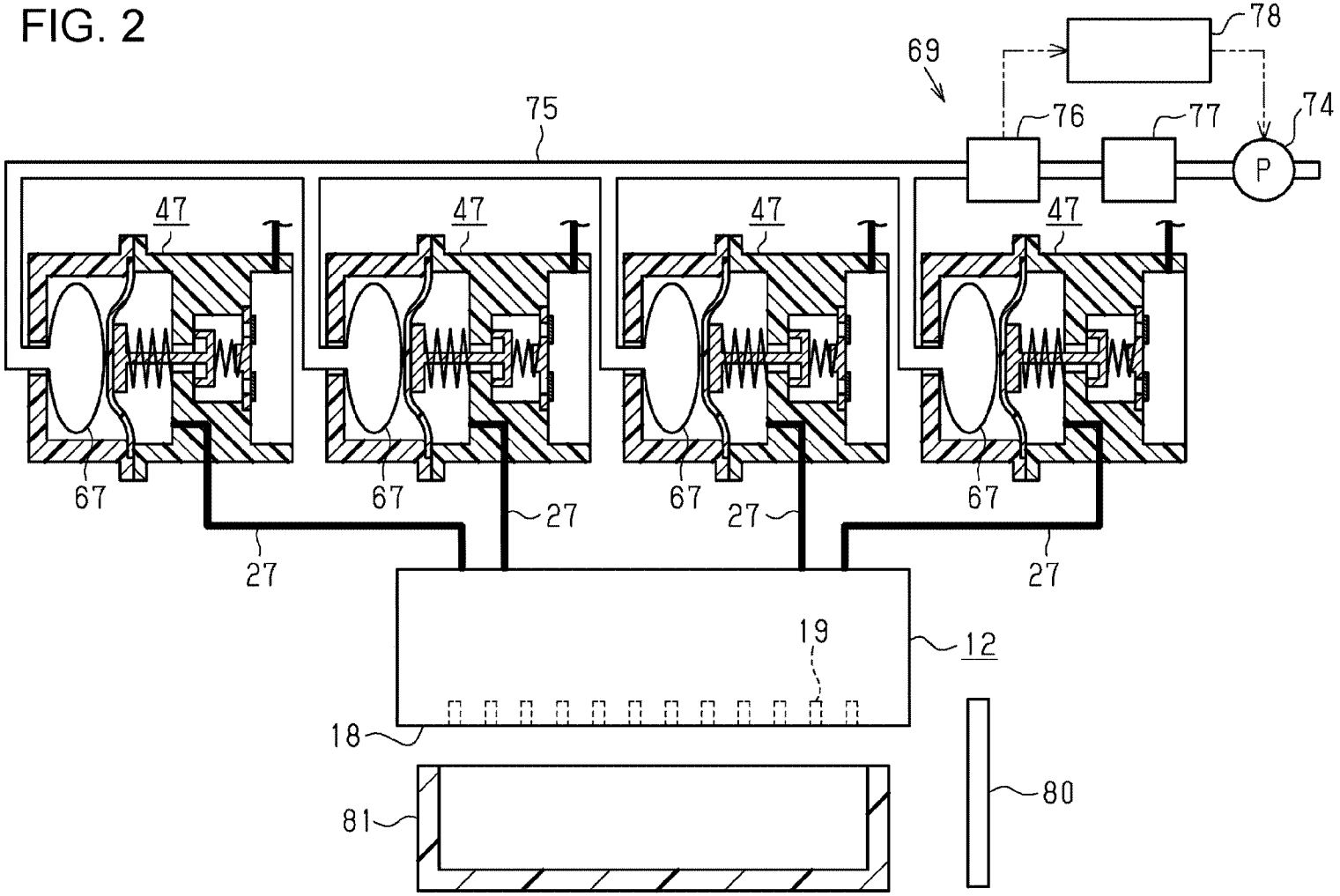
FIG. 2 is a schematic view of a plurality of pressure-regulating devices and pressure regulators.

As illustrated in FIG. 2, the pressure regulator 69 is provided with a pressure pump 74 which pressurizes the fluid, a connection path 75 which connects the pressure pump 74 and the expansion and contraction section 67, and a detector 76 and a fluid pressure regulator 77 provided in the connection path 75. The downstream side of the connection path 75 is branched, and is connected to each expansion and contraction section 67 of a plurality (in the embodiment, 4) of provided pressure-regulating devices 47.

That is, the fluid pressurized by the pressure pump 74 is supplied to each of the expansion and contraction sections 67 via the connection path 75. The detector 76 detects the pressure of the fluid supplied in the connection path 75, and the fluid pressure regulator 77 adjusts the pressure so that the fluid reaches a predetermined pressure by opening the valve and fluid escaping in a case there the pressure of the supplied fluid becomes higher than a predetermined pressure.

The liquid ejecting apparatus 11 is provided with a controller 78 which controls the driving of the pressure pump 74 based on the pressure of the fluid detected by the detector 76. The controller 78 also integrally controls the driving of each mechanism in the liquid ejecting apparatus 11.

The liquid ejecting apparatus 11 is provided with a wiping member 80 which wipes the nozzle forming surface 18, and a liquid receiving portion 81 which receives the liquid discharged from the nozzles 19 accompanying flushing or the like. The flushing is an operation by which the actuator 24 is driven and droplets are forcibly ejected from the nozzle 19 unrelated to printing.

Next, the action of the pressure-regulating device 47 which adjusts the pressure of the liquid supplied to the liquid ejecting unit 12 will be described.

As illustrated in FIG. 1, when the liquid ejecting unit 12 ejects the liquid, the liquid accommodated in the liquid accommodation part 51 is supplied to the liquid ejecting unit 12 via the liquid supply path 27. Thus, the pressure in liquid accommodation part 51 is lowered.

The diaphragm portion 56 increasingly flexurally deforms in the direction in which the volume of the liquid accommodation part 51 reduces as the difference between the pressure applied to the first surface 56*a* and the pressure applied to the second surface 56*b* increases. When the pressure receiving section 61 is pressed and moves according to the deformation of the diaphragm portion 56, the on-off valve 59 enters the open state.

The liquid in the liquid inflow part 50 is pressurized by the pressurizing mechanism 31. Therefore, when the on-off valve 59 opens, the liquid is supplied from the liquid inflow part 50 to the liquid accommodation part 51, and the pressure in the liquid accommodation part 51 rises. Thus, the diaphragm portion 56 deforms so that the volume of the liquid accommodation part 51 is increased. When the difference between the pressure applied to the first surface 56*a* and the pressure applied to the second surface 56*b* becomes lower than the predetermined value, the on-off valve 59 is put in the closed state from the open state, and the flow of the liquid is regulated.

In this way, the pressure-regulating mechanism 35 regulates the pressure in the liquid ejecting unit 12 at which the nozzles 19 have back pressure by causing the diaphragm portion 56 to be displaced, thereby regulating the pressure of the liquid supplied to the liquid ejecting unit 12.

Next, the action in a case where pressure cleaning is performed by forcibly causing the liquid to flow from the liquid supply source 13 to the liquid ejecting unit 12 in order to perform maintenance of the liquid ejecting unit 12 will be described.

As illustrated in FIG. 2, the controller 78 drives the pressure pump 74, and supplies the pressurized liquid fluid to the expansion and contraction section 67.

Figure 3:
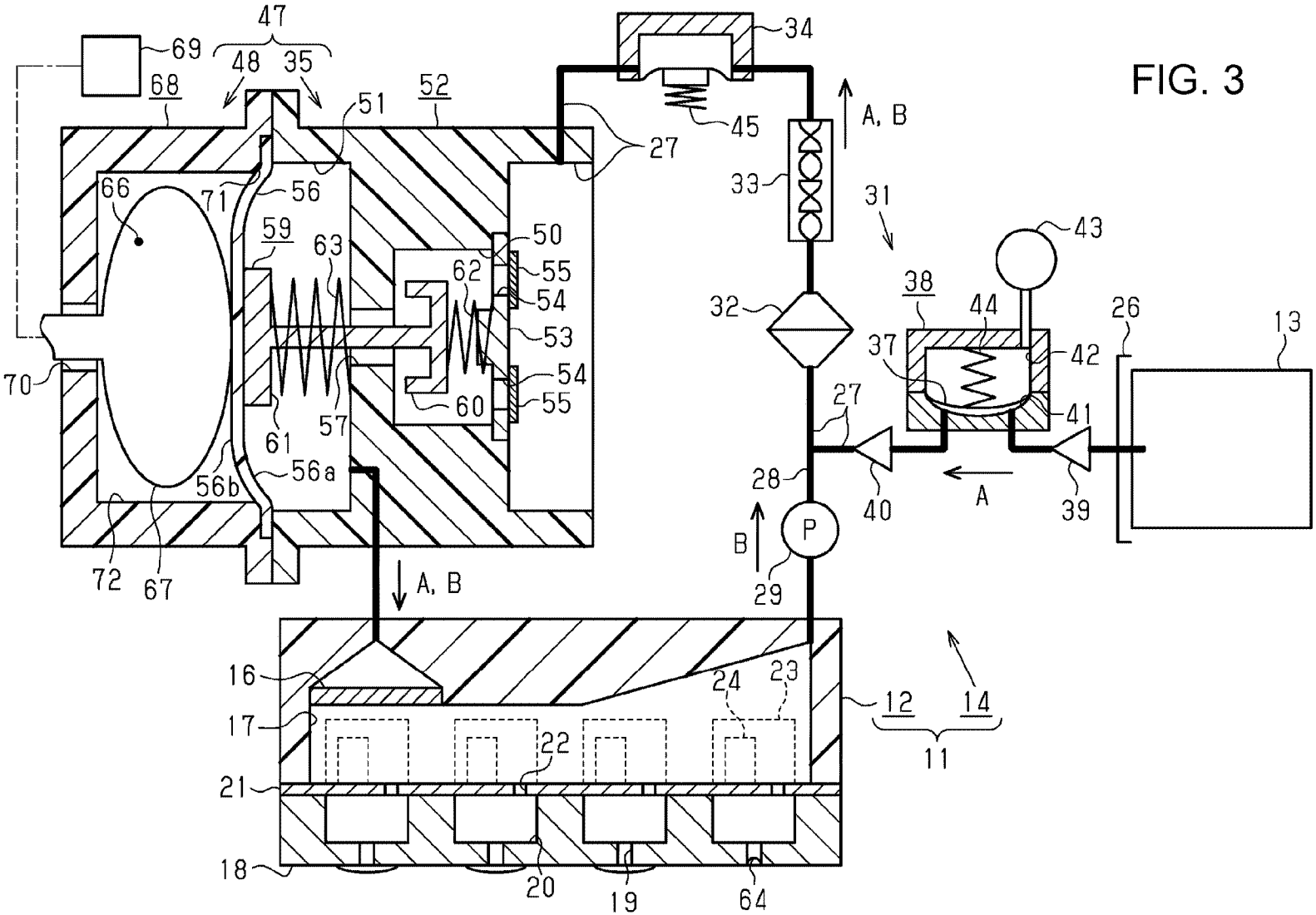
FIG. 3 is a schematic view of the liquid ejecting apparatus in a state where an on-off valve is opened.

As illustrated in FIG. 3, the expansion and contraction section 67 to which the fluid is supplied expands and presses the region with which the pressure receiving section 61 comes in contact in the diaphragm portion 56. That is, the pressing mechanism 48 puts the on-off valve 59 in the open state by the pressure receiving section 61 being moved while resisting the biasing force of the upstream side biasing member 62 and the downstream side biasing member 63. The pressure regulator 69 puts the on-off valves 59 of the pressure-regulating devices 47 in the open state because of being connected to the expansion and contraction sections 67 of the plurality of pressure-regulating devices 47.

At this time, because the diaphragm portion 56 deforms in the direction in which the volume of the liquid accommodation part 51 decreases, at this time, the liquid accommodated in the liquid accommodation part 51 is pushed out to the liquid ejecting unit 12 side. That is, the meniscus 64 is broken and the liquid overflows from the nozzle 19 by the pressure with which the diaphragm portion 56 presses the liquid accommodation part 51 being transferred to the liquid ejecting unit 12. That is, the pressing mechanism 48 presses the diaphragm portion 56 so that the pressure in the liquid accommodation part 51 becomes greater than the pressure (for example, at the gas-liquid interface, the pressure on the liquid side becomes a 3 kPa higher than the pressure on the gas side) at which at least one meniscus 64 collapses. The pressing mechanism 48 further puts the on-off valve 59 in the open state regardless of the pressure in the liquid inflow part 50 by pressing the diaphragm portion 56. That is, the pressing mechanism 48 presses the diaphragm portion 56 with a pressing force greater than the pressing force generated in a case where a pressure in which the above-described predetermined value is added to the pressure with which the pressurizing mechanism 31 pressurizes the liquid is applied to the diaphragm portion 56.

The liquid ejecting apparatus 11 supplied the liquid pressurized by the pressurizing mechanism 31 to the liquid ejecting unit 12 by periodically driving the pressure reduction unit 43 in the state where the on-off valve 59 by the pressing mechanism 48 pressing the diaphragm portion 56. That is, when the pressure in the negative pressure chamber 42 is reduced accompanying the driving of the pressure reduction unit 43, the flexible member 37 moves in the direction in which the volume of the pump chamber 41 is increased. Thus, the liquid flows into the pump chamber 41 from the liquid supply source 13. When the pressure is released by the pressure reduction unit 43, the flexible member 37 is biased by the biasing member 44 in the direction in which the volume of the pump chamber 41 is reduced. That is, the liquid in the pump chamber 41 is pressurized by the biasing member 44 via the flexible member 37, and supplied to the downstream side of the liquid supply path 27 passing through the downstream side one-way valve 40.

Because the open state of the on-off valve 59 is maintained, when the pressurizing mechanism 31 pressurizes the liquid, the pressurizing force is transferred to the liquid ejecting unit 12 via the liquid inflow part 50, the communication path 57, and the liquid accommodation part 51, and the liquid is discharged from the nozzle 19.

In a case where the pressure cleaning is finished, the liquid ejecting apparatus 11 releases the pressure state of the diaphragm portion 56 by the pressing mechanism 48, thereby putting the on-off valve 59 in the closed state in the state where the liquid is pressurized by the pressurizing mechanism 31. The liquid ejecting apparatus 11 drives the actuator 24 of the liquid ejecting unit 12 in the process where the on-off valve 59 is moved from the open state to the closed state. That is, when the actuator 24 is driven, the liquid is ejected from the nozzle 19 and the ejected portion of the ink is supplied from the liquid accommodation part 51 to the liquid ejecting unit 12. Therefore, the on-off valve 59 is closed in a state where the liquid is caused to flow from the liquid inflow part 50 from the liquid accommodation part 51.

Thereafter, the liquid ejecting apparatus 11 performs wiping in which the nozzle forming surface 18 is wiped with the wiping member 80, and the actuator 24 is driven, thereby performing flushing. The meniscus 64 is formed in the nozzle 19.

Next, the method of manufacturing in which the pressure-regulating mechanism 35 and the pressing mechanism 48 are joined, thereby manufacturing the pressure-regulating device 47 will be described.

The main body unit 52 of the embodiment is formed of a light absorbent resin (for example, polypropylene) which generates heat when absorbing laser light, or a resin colored with a dye which absorbs light. The diaphragm portion 56 is formed by different materials such as polypropylene and polyethylene terephthalate being layered, and has transmissivity which allows laser light to pass through and flexibility. The pressing member 68 is formed by a light transmissive resin (for example, polystyrene or polycarbonate) which transmits laser light. That is, the transparency of the diaphragm portion 56 is greater than the transparency of the main body unit 52 and lower than the transparency of the pressing member 68.

As illustrated in FIG. 1, first, the diaphragm portion 56 is pinched by the pressing member 68 and the main body unit 52 in which the expansion and contraction section 67 is inserted in the insertion hole 70 (pinching step). Laser light is radiated via the pressing member 68 (radiation step). Thus, laser light passing through the pressing member 68 is absorbed by the main body unit 52 and heat is generated. The main body unit 52, the diaphragm portion 56, and the pressing member 68 are fused together by the generated heat. Therefore, the pressing member 68 functions as a jig which presses the diaphragm portion 56 when manufacturing the pressure-regulating device 47.

According to first embodiment, the following effects can be obtained.

(1) It is possible for the pressing mechanism 48 to put the on-off valve 59 in an open state regardless of the pressure in the liquid inflow part 50 even if the pressure in the liquid inflow part 50 fluctuates or increases. Therefore, the liquid can be stably supplied to the liquid ejecting unit 12.

(2) The pressure regulator 69 presses the diaphragm portion 56 in the direction in which the volume of the liquid accommodation part 51 is reduced by regulating the pressure in the pressure-regulating chamber 66. Therefore, it is possible for the pressing mechanism 48 to favorably press the diaphragm portion 56.

(3) The pressure regulator 69 presses the diaphragm portion 56 in the direction in which the volume of the liquid accommodation part 51 is reduced by causing the expansion and contraction section 67 to expand. Therefore, it is possible for the pressing mechanism 48 to favorably press the diaphragm portion 56.

(4) For example, the liquid is supplied at a higher pressure than the pressure at which the meniscus 64 collapses during pressure cleaning in which the liquid which is pressurized and supplied from the liquid supply source 13 side is discharged from the nozzles 19. On this feature, because the pressure in the liquid accommodation part 51 at which the diaphragm portion 56 is pressed by the pressing mechanism 48 is higher than the pressure at which the meniscus 64 collapses, it is possible for the on-off valve 59 to be put in the open state even in a case of performing pressure cleaning.

(5) Because the pressing mechanism 48 presses the region which contacts the pressure receiving section 61 in the diaphragm portion 56, it is possible to restrict deformation of the diaphragm portion 56 compared to a case where the pressure-regulating mechanism 35 does not include the pressure receiving section 61. Accordingly, concern of gas or the like being drawn in from the nozzles 19 can be reduced in a case where the pressing mechanism 48 releases the pressing of the diaphragm portion 56, and the diaphragm portion 56 deforms in a direction in which the volume of the liquid accommodation part 51 increases.

(6) It is possible for cleaning of the liquid ejecting unit 12 to be favorably performed by supplying the liquid pressurized by the pressurizing mechanism 31 to the liquid ejecting unit 12 in a state where the on-off valve 59 is opened.

(7) Because the diaphragm portion 56 pressed by the pressing mechanism 48 puts the on-off valve 59 in the open state by displacing in a direction in which the volume of the liquid accommodation part 51 is reduced, when the pressing of the pressing mechanism 48 is released, the diaphragm portion 56 displaces in a direction in which the volume of the liquid accommodation part 51 increases. On this feature, because the liquid pressurized by the pressurizing mechanism 31 is supplied to the pressure-regulating mechanism 35, the concern of the liquid being drawn in from the liquid ejecting unit 12 side can be reduced. Accordingly, the concern of gas or the like being drawn in from the nozzles 19 can be reduced.

(8) The liquid ejecting unit 12 ejects the liquid supplied from the liquid supply source 13 from the nozzles 19 by driving the actuator 24. That is, because it is possible for the liquid to be caused to flow from the liquid supply source 13 side towards the liquid ejecting unit 12 side, it is possible to reduce the concern of gas and the like being drawn in from the nozzles 19.

(9) It is possible to put the on-off valve 59 in the open state regardless of the pressure in the liquid inflow part 50. Therefore, it is possible to supply the liquid to the liquid ejecting unit 12 by putting the on-off valve 59 in the open state, even in a case where the pressure in the liquid inflow part 50 increases during recording in which recording is performed on a medium by ejecting the liquid from the nozzle 19. Therefore, it is possible to suppress interruption of the recording process and lowering of the recording quality accompanying the interruption.

(10) Because the fluid pressure regulator 77 is provided in the connection path 75, it is possible to regulate the pressure of the fluid supplied to the expansion and contraction section 67 even in a case where the pressure in the connection path 75 increases by the pressure pump 74 being unexpectedly driven. Accordingly, it is possible to lower concern of unexpected pressure being applied to the expansion and contraction section 67.

(11) After the on-off valve 59 enters the closed state from the open state, it is possible to prepare the meniscus 64 by performing wiping and flushing. In a case where the diaphragm portion 56 moves in a direction in which the volume of the liquid accommodation part 51 is increased, it is possible to prepare the meniscus 64 even in a case where the liquid overflows from the nozzle 19 while the region which does not come in contact with the pressure receiving section 61 moves in a direction in which the volume of the liquid accommodation part 51 is reduced.

Second Embodiment

Next, the second embodiment of the liquid ejecting apparatus will be described with reference to the drawings. It should be noted that the pressurizing mechanism in the second embodiment differs from the case of the first embodiment. Because the other features are substantially the same as the first embodiment, the same configurations are given the same reference numerals and overlapping description will not be provided.

Figure 4:
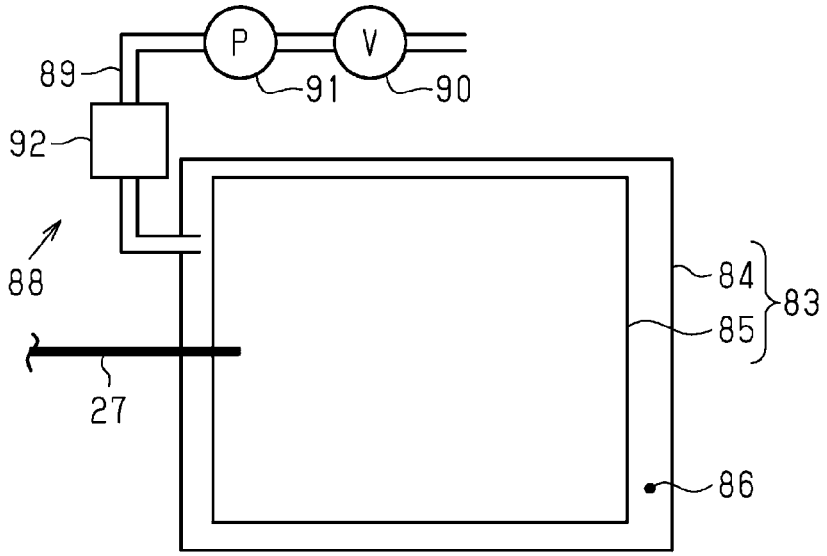
FIG. 4 is a schematic view of a pressurizing mechanism in the liquid ejecting apparatus of a second embodiment.

As illustrated in FIG. 4, the liquid supply source 83 is formed of an outer case 84 formed in an airtight state, and a liquid pack 85 which is accommodated in the outer case 84 and is able to deform in a state where the liquid is sealed, and a pressure chamber 86 is created between the outer case 84 and the liquid pack 85.

The pressurizing mechanism 88 pressurizes the liquid supplied to the pressure-regulating mechanism 35 by pressurizing the pressure chamber 86. That is, the pressurizing mechanism 88 is provided with a pressurizing path 89 connected to the pressure chamber 86, a release valve 90 provided in the pressurizing path 89, a supply pump 91, and an air pressure regulator 92. The release valve 90 permits the flow of air in the pressurizing path 89 by opening, and regulates the flow of air by closing. The supply pump 91 supplies air to the pressure chamber 86 via the pressurizing path 89. The air pressure regulator 92 adjusts the pressure of the supplied air similarly to the fluid pressure regulator 77 provided in the pressing mechanism 48.

The pressure chamber 86 is pressurized by the supply pump 91 being driven in a state where the release valve 90 is opened. The pressure chamber 86 is maintained in the pressurized state by the release valve 90 opening in a state where the supply pump 91 pressurizes the pressure chamber 86.

Next, the action in a case where pressure cleaning is performed by forcibly causing the liquid to flow from the liquid supply source 83 to the liquid ejecting unit 12 in order to perform maintenance of the liquid ejecting unit 12 will be described.

The liquid ejecting apparatus 11 drives the pressing mechanism 48 similarly to the first embodiment, thereby causing the on-off valve 59 to open. In the open state of the on-off valve 59, the pressurizing force which pressurizes the liquid with the pressurizing mechanism 88 is changed. That is, after the liquid is pressurized at the first pressurizing force with the controller 78 driving the supply pump 91, the driving of the supply pump 91 is changed, thereby pressurizing the liquid at a second pressurizing force different to the first pressurizing force. The first pressurizing force may be higher than the second pressurizing force, or may be lower.

When the pressurizing force is changed, the flow rate, which is the amount of liquid ejected from the liquid ejecting unit 12 while flowing in the liquid supply path 27 per unit time, changes. That is, the flow rate in a case where the liquid is pressurized at the first pressurizing force which is higher than the second pressurizing force is greater than the flow rate in a case where the liquid is pressurized at the second pressurizing force.

According to the second embodiment, it is possible to obtain the following effects in addition to the effects (1) to (11) of the first embodiment.

(12) Because it is possible for the on-off valve 59 to be put in the open state regardless of the pressure in the liquid inflow part 50, the on-off valve 59 maintains the open state even if the pressurizing force which pressurizes the liquid by means of the pressurizing mechanism 88 changes. Accordingly, it is possible for cleaning to be more favorably performed because it is possible for the liquid to be supplied at a pressurizing force in response to the state of the liquid ejecting unit 12.

It should be noted that the embodiment may be modified as below.

Figure 5:
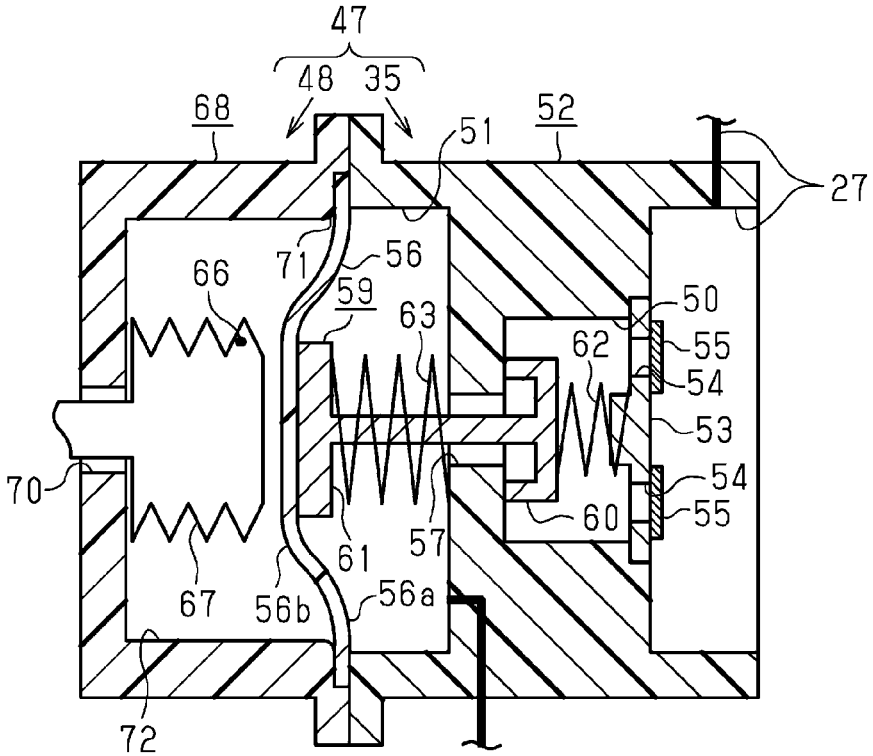
FIG. 5 is a schematic view of a first modification example of the pressure-regulating device.

As illustrated in FIG. 5, the expansion and contraction section 67 may be a bellows, the side surface of which has an accordion fold shape (first modification example). That is, for the expansion and contraction section 67, the bellows expands so that the accordion fold extends when the pressure-regulating chamber 66 and the bellows contracts when the pressure in the pressure-regulating chamber 66 is released.

Figure 6:
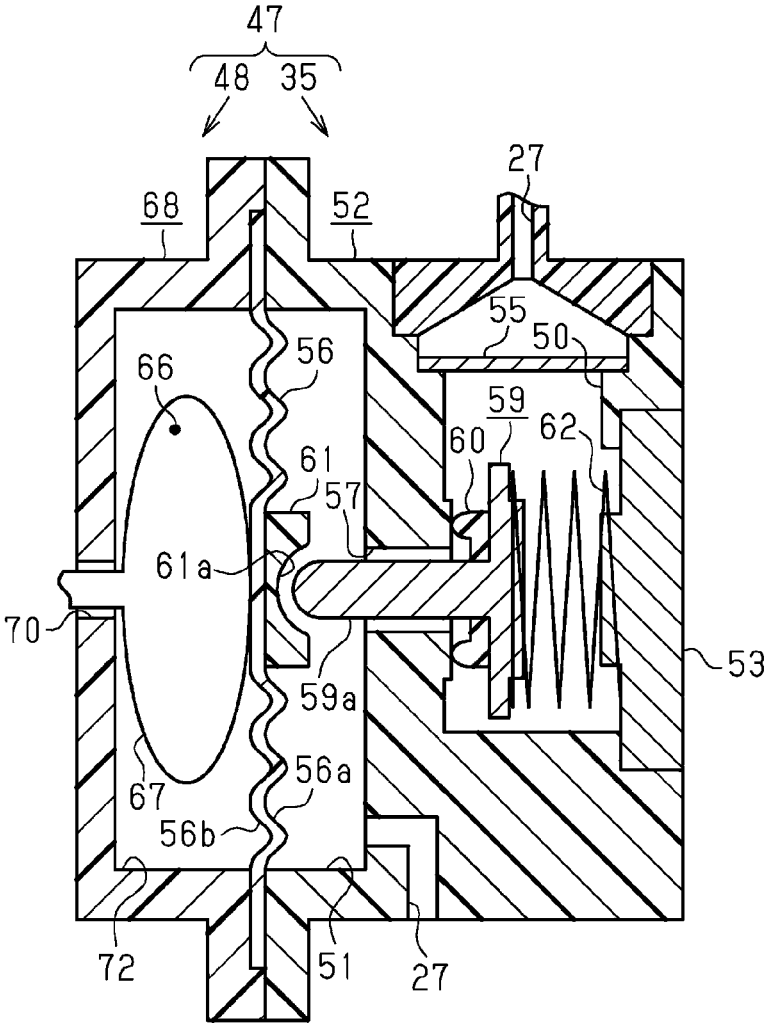
FIG. 6 is a schematic view of a second modification example of the pressure-regulating device.

As illustrated in FIG. 6, the pressure receiving section 61, which is an example of a moving member, may be a member separate to the on-off valve 59 (second modification example). The pressure receiving section 61 is provided on the diaphragm portion 56 and the pressure receiving section 61 may be moved accompanying the displacement of the diaphragm portion 56. The pressing mechanism 48 may cause the diaphragm portion 56 to displace in a range where the pressure receiving section 61 does not press the projection portion 59*a* of the on-off valve 59, and may perform maintenance of the liquid ejecting unit 12 while an amount of the liquid of the volume change in the liquid accommodation part 51 is discharged from the nozzle 19. A recessed portion 61*a* which engages the projection portion 59*a* may be formed in the pressure receiving section 61.

As illustrated in FIG. 6, the disk-shaped diaphragm portion 56 may have a colgate (wave shape) shape in which the concentric recessed portions and the projection portions which are centered on the central portion of the diaphragm portion 56 are alternately formed from the central portion to the end portion. That is, the diaphragm portion 56 may be formed with the first surface 56*a* and the second surface 56*b* in a wavelike formation. The diaphragm portion 56 may be formed of a rubber or resin with a thickness having flexibility.

As illustrated in FIG. 6, the liquid supply path 27 may be connected at a portion different to the wall section 53 which supports the upstream side biasing member 62 in the liquid inflow part 50. The filter member 55 may be provided at a position different to the wall section 53.

As illustrated in FIG. 6, a configuration may be used which is not provided with the downstream side biasing member 63. That is, the diaphragm portion 56 may be displaced from a position in which the volume of the liquid accommodation part 51 is reduced due to elasticity in a direction in which the volume increases. The diaphragm portion 56 may be bonded to the expansion and contraction section 67. That is, the diaphragm portion 56 may be displaced from a position in which the volume of the liquid accommodation part 51 is reduced due to elasticity in a direction in which the volume increases as the expansion and contraction section 67 contracts.

Figure 7:
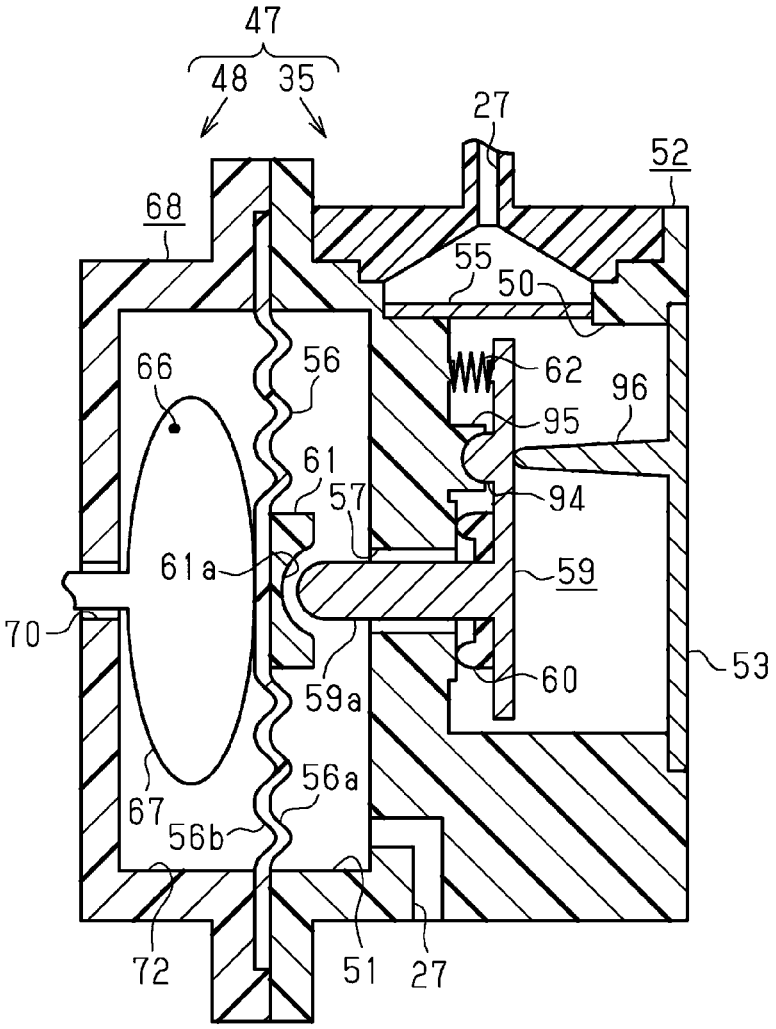
FIG. 7 is a schematic view of a third modification example of the pressure-regulating device.

As illustrated in FIG. 7, the on-off valve 59 may switch between the open state and the closed state by oscillating with the shaft 94 as a center (third modification example). Due to the on-off valve 59 being oscillated, it is possible for the opening operation of the on-off valve 59 to be stabilized compared to a case of the on-off valve 59 being moved in the biasing direction of the upstream side biasing member 62. The on-off valve 59 is supported so that the shaft 94 is pinched by the bearing 95 and the support section 96. In the on-off valve 59, the valve portion 60 is provided closer to one end side than the shaft 94, and the other side is biased by the upstream side biasing member 62. That is, the upstream side biasing member 62 biases the on-off valve 59 in a direction in which the valve portion 60 closes off the communication path 57.

Figure 8:
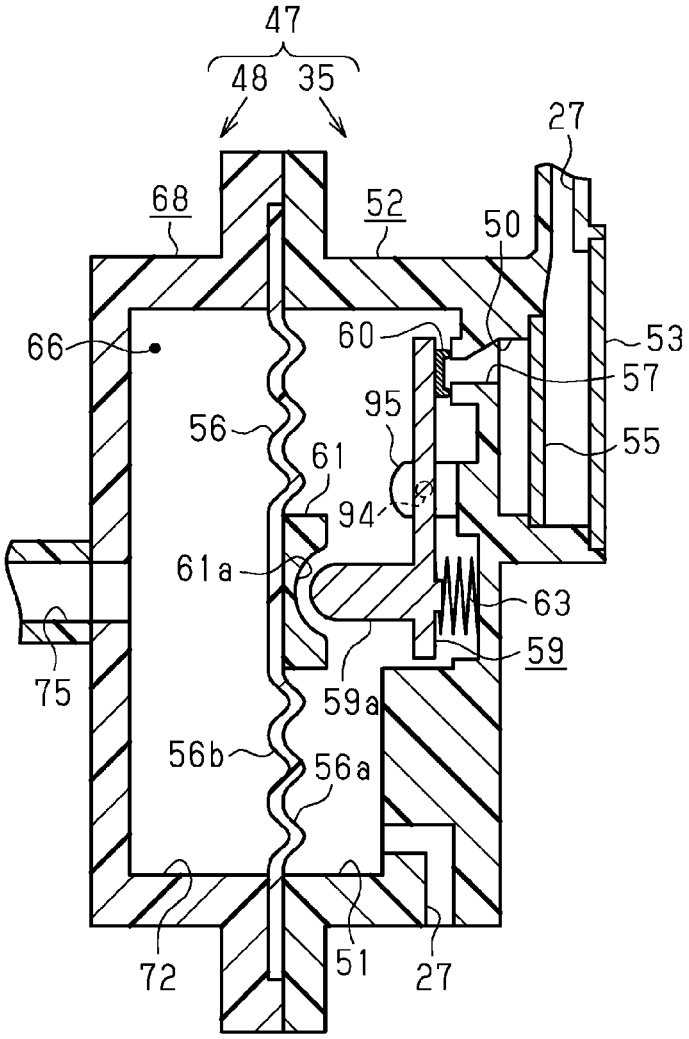
FIG. 8 is a schematic view of a fourth modification example of the pressure-regulating device.

As illustrated in FIG. 8, the on-off valve 59 may be provided in the liquid accommodation part 51 (fourth modification example).

As illustrated in FIG. 8, the pressing mechanism 48 may have a configuration which is not provided with the expansion and contraction section 67. That is, the air chamber 72 which is formed between the pressing member 68 and the diaphragm portion 56 may function as the pressure-regulating chamber 66. The pressing mechanism 48 may press the entirety of the second surface 56*b* of the diaphragm portion 56 by pressurizing the pressure-regulating chamber 66, and may press the region that does not contact the pressure receiving section 61 in the diaphragm portion 56.

Figure 9:
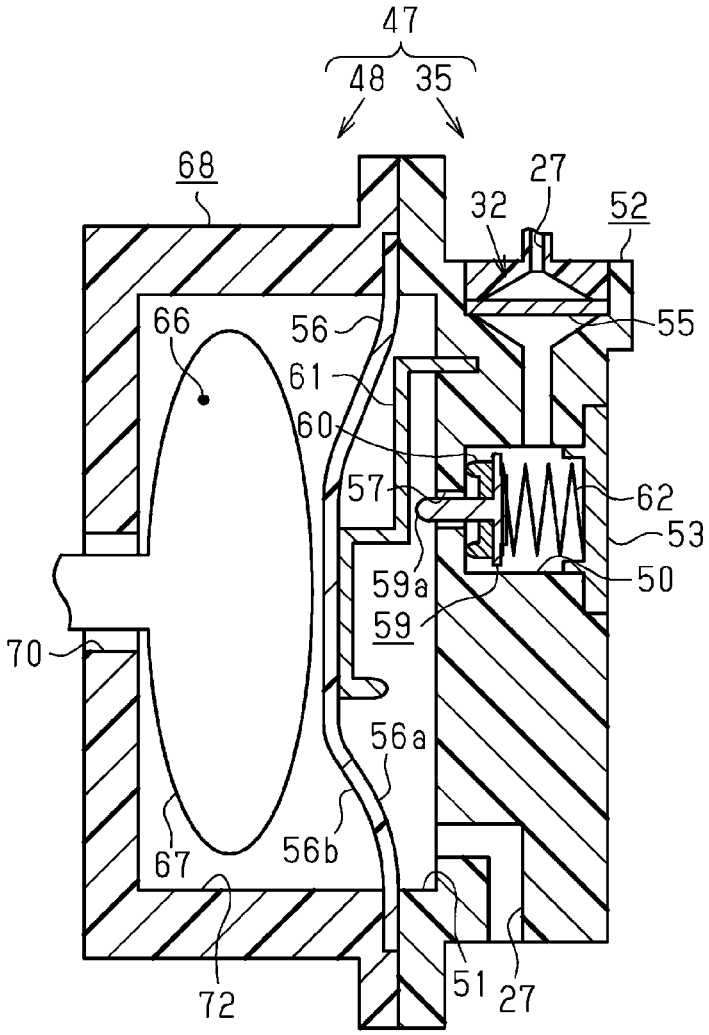
FIG. 9 is a schematic view of a fifth modification example of the pressure-regulating device.

As illustrated in FIG. 9, the pressure receiving section 61 may be a cantilever supported spring, and may cause the on-off valve 59 to open by deforming due to the end portion being pressed by the diaphragm portion 56 (fifth modification example). The pressure receiving section 61 presses the on-off valve 59 at a portion closer to the base end side than the portion pressed by the diaphragm portion 56.

According to the fifth modification example, the pressure receiving section 61 becomes a lever. That is, the base end portion of the pressure receiving section 61 becomes the support point and the tip end portion pressed by the diaphragm portion 56 becomes the power point, and the action point which presses the on-off valve 59 is positioned between the support point and the power point. Therefore, it is possible for the pressure receiving section 61 to press the on-off valve 59 with the pressure with which the diaphragm portion 56 presses changing to a greater pressure.

As illustrated in FIG. 9, the pressure-regulating device 47 may be provided with a filter unit 32. The liquid ejecting apparatus 11 may have a configuration which is not provided with a static mixer 33 or a liquid storage unit 34.

In each of the above-described embodiments, the pressing mechanism 48 may press the diaphragm portion 56 by air being ejected from an ejection port formed in the pressure-regulating chamber 66. It is preferable that the ejection port be formed at a position facing the region which comes in contact with the pressure receiving section 61 in the diaphragm portion 56. That is, the region which comes in contact with the pressure receiving section 61 in the diaphragm portion 56 may be pressed by the pressure of the air ejected from the ejection port accompanying the pressure regulator 69 adjusting the pressure in the pressure-regulating chamber 66 to a higher pressure than the atmospheric pressure.

In each of the above-described embodiments, the liquid ejecting apparatus 11 may be provided with a plurality of pressure regulators 69. For example, the pressure regulator 69 may be provided for each pressing mechanism 48.

In each of the above-described embodiments, the pressure receiving section 61 may be provided on the second surface 56*b* of the diaphragm portion 56. That is, the pressing mechanism 48 may press the diaphragm portion 56 via the pressure receiving section 61.

In each of the above-described embodiments, the liquid ejecting apparatus 11 may have a configuration which is not provided with the circulation path forming section 28 and the circulating pump 29.

In each of the above-described embodiments, the fluid supplied to the pressure-regulating chamber 66 may be a gas, such as air, or may be a liquid, such as water or oil.

In each of the above-described embodiments, the pressure in the liquid accommodation part 51 at which the on-off valve 59 is put in the open state from the closed state may change due to the pressure in the air chamber 72 changing. That is, it is possible for the conditions in which the on-off valve 59 opens to be changed by changing the magnitude of the pressure applied to the second surface 56*b* because the diaphragm portion 56 displaces in response to the difference between the pressure applied to the first surface 56*a* and the pressure applied to the second surface 56*b*.

In each of the above-described embodiments, the actuator 24 may not be driven in the process of putting the on-off valve 59 in the closed state from the open state.

In each of the above-described embodiments, after the pressure of the liquid is released by the pressurizing mechanisms 31 and 88, the on-off valve 59 may be put in the closed state from the open state by releasing the pressing state of the diaphragm portion 56 due to the pressing mechanism 48.

In the second embodiment, in the open state of the on-off valve 59, the pressurizing force which pressurizes the liquid by means of the pressurizing mechanism 88 may be constant. The pressurizing force which pressurizes the liquid by means of the pressurizing mechanism 88 may be changed in response to the state of the liquid ejecting unit 12 or the frequency at which the pressure cleaning is performed.

In each of the above-described embodiments, a plurality of pressurizing mechanisms 31 and 88 or different types of pressurizing mechanism may be provided, and the pressurizing force which pressurizes the liquid may be changed by selecting the pressurizing mechanism which is driven. It is possible to arbitrarily select a gear pump, a screw pump, a piston pump or the like as the pressurizing mechanism.

In each of the above-described embodiments, a configuration may be used which is not provided with the pressurizing mechanisms 31 and 88. For example, the liquid may be supplied to the liquid ejecting unit 12 from the liquid supply sources 13 and 83 by the water head.

In each of the above-described embodiments, a configuration may be used which is not provided with the pressure receiving section 61.

In each of the above-described embodiments, the pressing mechanism 48 may not press the diaphragm portion 56 with a greater pressing force than the pressing force generated in a case where the pressure in which the above-described predetermined value is added to the pressure with which the pressurizing mechanism 31 pressurizes the liquid in the pump chamber 41 (in the case of a pressurizing mechanism 88, pressure which pressurizes the liquid in the liquid pack 85) is applied to the diaphragm portion 56 when the pressing mechanism 48 presses the diaphragm portion 56 so that the pressure within the liquid accommodation part 51 becomes higher than the pressure at which the meniscus 64 collapses.

In a case where the liquid is discharged from the nozzle 19 during pressure cleaning, a pressure loss occurs due to the flow of the liquid since the liquid also flows in the liquid supply path 27, the liquid inflow part 50, and the communication path 57 closer to the downstream side (in the case of a pressurizing mechanism 88, closer to the downstream side than the liquid pack 85) than the pump chamber 41 of the pressurizing mechanism 31. Therefore, in a case where the liquid is discharged from the nozzle 19, the pressure in the liquid accommodation part 51 becomes a pressure in which the above-described pressure loss is subtracted from the pressure with which the pressurizing mechanism 31 pressurizes the liquid in the pump chamber 41 (in the case of a pressurizing mechanism 88, pressure which pressurizes the liquid in the liquid pack 85). Taking the pressure loss into consideration, the pressing mechanism 48 may press the diaphragm portion 56 with a greater pressing force than the pressing force generated in a case where the pressure in which the above-described predetermined value is added to the pressure in which the above-described pressure loss is subtracted from the pressure with which the pressurizing mechanism 31 pressurizes the liquid in the pump chamber 41 (in the case of a pressurizing mechanism 88, pressure which pressurizes the liquid in the liquid pack 85) is imparted to the diaphragm portion 56.

In each of the above-described embodiments, the pressing mechanism 48 may press the diaphragm portion 56 so that the pressure in the liquid accommodation part 51 becomes lower than the pressure at which the meniscus 64 collapses.

In each of the above-described embodiments, a configuration may be used which is not provided with the pressure regulator 69. For example, the pressing mechanism 48 may mechanically press by means of a cam mechanism.

In the embodiment, the liquid ejecting apparatus may be a liquid ejecting apparatus which ejects and discharges liquids other than ink. The state of the liquid discharge from the liquid ejecting apparatus as minute droplets includes droplets which are particle-like, tear drop-like, or are drawn to have thread-like tails. Here, the liquid may be any material that is able to be ejected from the liquid ejecting apparatus. For example, as long as the material has a state where the substance is a liquid phase, liquid-like substances such as a high or low viscosity liquid-like substance, sols, gel water, other inorganic solvents, organic solvents, solutions, liquid-like resins, and liquid-like metals (metal melts) are included. Not only a liquid as one state of the substance, but also particles of a functional material formed of a solvent such as a pigment or metal particles dissolved, dispersed, or mixed in a solvent and the like are included.

Representative examples of the liquid include inks as described in the above embodiments and liquid crystals. Here, the wording "ink" generally encompasses aqueous inks and oil-based inks, as well as various liquid compositions such as gel inks and hot melt inks. Liquid ejecting apparatuses such which eject a liquid which includes an electrode material or a material such as a coloring material used in the manufacturing of an electroluminescence (EL) displays, surface emission displays, and color filters in the form of a dispersion or solution are specific examples of the liquid ejecting apparatus. A liquid ejecting apparatus which ejects a bio-organic material used in biochip manufacturing, a liquid ejecting apparatus which is used as a precision pipette and ejects a liquid which becomes a sample, a textile printing device, a microdispenser and the like are also included. A liquid ejecting apparatus which ejects a pinpoint of a lubricating oil to a precision device, such a watch or a camera and a liquid ejecting apparatus which ejects a transparent resin material such as an ultraviolet curable resin onto a substrate in order to form a minute semi-spherical lens (optical lens) or the like used in an optical communication or the like may also be included. A liquid ejecting apparatus which ejects an etching liquid such as an acid or an alkali for etching a substrate or the like may also be included.

What is claimed is:

1. A liquid ejecting apparatus, comprising:

a liquid supply path which is designed to supply a liquid from a liquid supply source to a liquid ejecting unit which ejects the liquid from a nozzle;

a pressure-regulating mechanism provided in the liquid supply path, the pressure-regulating mechanism including a liquid inflow part into which the liquid supplied from the liquid supply source flows;

a liquid accommodation part which is designed to accommodate the liquid;

a communication path through which the liquid inflow part and the liquid accommodation part communicate, and an on-off valve which enters an open state in which the liquid inflow part and the liquid accommodation part communicate from a closed state in which the liquid inflow part and the liquid accommodation part in the communication path do not communicate; and a pressurizing mechanism which is designed to pressurize the liquid supplied to the pressure-regulating mechanism, wherein the liquid ejecting unit includes an actuator which is driven when ejecting the liquid from the nozzle, and the actuator of the liquid ejecting unit is driven by a controller in a process which puts the on-off valve in the closed state from the open state.

2. The liquid ejecting apparatus according to claim 1, wherein the liquid pressurized by the pressurizing mechanism is supplied to the liquid ejecting unit in the open state of the on-off valve.

3. The liquid ejecting apparatus according to claim 2, wherein the pressurizing force which pressurizes the liquid is changed by the pressurizing mechanism in the open state of the on-off valve.

4. The liquid ejecting apparatus according to claim 2, wherein the pressing state of the diaphragm portion by the pressing mechanism is released and the on-off valve is put in the closed state in a state in which the liquid is pressurized by the pressurizing mechanism.

5. The liquid ejecting apparatus according to claim 1, wherein the on-off valve enters the open state from the closed state, when a pressure applied to a first surface which is an inner surface of the liquid accommodation part of a diaphragm portion is lower than the pressure applied to a second surface which is an outer surface of the liquid accommodation part of the diaphragm portion, and a difference between the pressure applied to the first surface and the pressure applied to the second surface is a predetermined value or more.

6. The liquid ejecting apparatus according to claim 5, further comprising:

a pressing mechanism which is designed to press the diaphragm portion in a direction in which the volume of the liquid accommodation part is reduced, and which puts the on-off valve in an open state regardless of the pressure in the interior of the liquid inflow part by pressing the diaphragm portion.

7. The liquid ejecting apparatus according to claim 6, wherein the pressing mechanism includes a pressure regulator which is designed to regulate a pressure within a pressure-regulating chamber formed on the second surface side of the diaphragm portion, and the pressing mechanism presses the diaphragm portion by the pressure regulator regulating the pressure within the pressure-regulating chamber to be a higher pressure than atmospheric pressure.

8. The liquid ejecting apparatus according to claim 7, wherein the pressing mechanism further includes an expansion and contraction section which is able to expand and contract and which forms the pressure-regulating chamber, and the pressing mechanism presses the diaphragm portion by the pressure regulator causing the expansion and contraction section to expand.

9. The liquid ejecting apparatus according to claim 6, wherein the pressing mechanism presses the diaphragm portion so that the pressure in the liquid accommodation part becomes higher than the pressure at which the meniscus formed at the gas-liquid interface collapses in the nozzle.

10. The liquid ejecting apparatus according to claim 6, wherein the pressure-regulating mechanism further includes a moving member which is designed to move in a state of contact with the diaphragm portion which displaces in a direction in which the volume of the liquid accommodation part is reduced, and the pressing mechanism presses a region in the diaphragm portion which comes in contact with the moving member.

11. A maintenance method of a liquid ejecting apparatus comprising the steps of:

providing the liquid ejecting apparatus having:

a liquid ejecting unit which ejects a liquid from a nozzle, the liquid ejecting unit including an actuator which is driven when ejecting the liquid from the nozzle;

a liquid supply path which is designed to supply the liquid from a liquid supply source to the liquid ejecting unit;

a pressure-regulating mechanism provided in the liquid supply path, the pressure-regulating mechanism including a liquid inflow part into which the liquid supplied from the liquid supply source flows;

a liquid accommodation part which is designed to accommodate the liquid;

a communication path through which the liquid inflow part and the liquid accommodation part communicate, and an on-off valve which enters an open state in which the liquid inflow part and the liquid accommodation part communicate from a closed state in which the liquid inflow part and the liquid accommodation part in the communication path do not communicate; and a pressurizing mechanism which is designed to pressurize the liquid supplied to the pressure-regulating mechanism;

putting the on-off valve in the open state in a state in which the liquid is pressurized by the pressurizing mechanism, and driving the actuator of the liquid ejecting unit in a process which puts the on-off valve in the closed state from the open state.

12. The maintenance method of a liquid ejecting apparatus according to claim 11, wherein the on-off valve is put in the closed state in a state in which the liquid is pressurized by the pressurizing mechanism in the process.

* * * * *